US009478868B2

(12) United States Patent
Henry et al.

(10) Patent No.: US 9,478,868 B2
(45) Date of Patent: Oct. 25, 2016

(54) CORRUGATED HORN ANTENNA WITH ENHANCED FREQUENCY RANGE

(75) Inventors: Cooper Henry, Fallbrook, CA (US); Sheng Peng, Lynnwood, WA (US); Ronald M. Westerberg, Temecula, CA (US); Paul Habeck, Temecula, CA (US); Floyd Phelps, Temecula, CA (US)

(73) Assignee: XI3, Salt Lake City, UT (US)

( * ) Notice: Subject to any disclaimer, the term of this patent is extended or adjusted under 35 U.S.C. 154(b) by 0 days.

(21) Appl. No.: 13/370,275

(22) Filed: Feb. 9, 2012

(65) Prior Publication Data

US 2012/0200470 A1 Aug. 9, 2012

Related U.S. Application Data

(60) Provisional application No. 61/440,983, filed on Feb. 9, 2011, provisional application No. 61/441,004, filed on Feb. 9, 2011.

(51) Int. Cl.

| | |
|---|---|
| ***H01Q 13/00*** | (2006.01) |
| ***H01Q 13/08*** | (2006.01) |
| ***H01Q 1/38*** | (2006.01) |

(52) U.S. Cl.

CPC ..... *H01Q 13/085* (2013.01); *H01Q 1/38* (2013.01)

(58) Field of Classification Search

CPC ..... H01Q 13/085; H01Q 1/38
USPC ..... 343/767, 770, 772, 786
See application file for complete search history.

(56) References Cited

U.S. PATENT DOCUMENTS

| | | | |
|---|---|---|---|
| 744,897 | A | 11/1903 | Braun |
| 2,270,314 | A | 1/1942 | Kraus |
| 3,921,177 | A | 11/1975 | Munson |
| 4,437,074 | A | 3/1984 | Cohen et al. |

(Continued)

FOREIGN PATENT DOCUMENTS

| | | | |
|---|---|---|---|
| CA | 2244369 | A1 | 1/1999 |
| EP | 2673834 | A1 | 12/2013 |

(Continued)

OTHER PUBLICATIONS

Balanis, "Antenna Theory: A Review", Proc. IEEE, vol. 80, No. 1, Jan. 1992, pp. 7-23.

(Continued)

*Primary Examiner* — Dameon E Levi
*Assistant Examiner* — Hasan Islam
(74) *Attorney, Agent, or Firm* — David B. Tingey; Kirton McConkie

(57) ABSTRACT

A radiator element for transmission and reception of RF communications formed of a planar conductive material positioned upon a planar dielectric substrate surface. Two lobes formed of the conductive material have side edges abutting a cavity decreasing in cross section between the lobes. The cavity has a widest point configured to receive RF frequencies at the lowest frequency and a narrowest point configured to receive a highest frequency of the element. The widest and narrowest point may be changed during manufacture to fit the frequency spectrum needed. Opposing pairs of recess cavities formed in the side edges of the lobes along the decreasing edges of the cavity enhance the frequency of operation for frequencies paired to the distance between the pairs of notches. Projections are employable along the side edges to optimize impedance.

1 Claim, 3 Drawing Sheets

(56) References Cited

U.S. PATENT DOCUMENTS

| | | | | |
|---|---|---|---|---|
| 4,814,777 | A | 3/1989 | Monser | |
| 4,843,403 | A * | 6/1989 | Lalezari et al. | 343/767 |
| 4,853,704 | A | 8/1989 | Diaz et al. | |
| 5,036,335 | A * | 7/1991 | Jairam | 343/767 |
| 5,124,712 | A | 6/1992 | Caille et al. | |
| 5,124,733 | A | 6/1992 | Haneishi | |
| 5,142,255 | A | 8/1992 | Chang et al. | |
| 5,534,880 | A | 7/1996 | Button et al. | |
| 5,541,611 | A * | 7/1996 | Peng et al. | 343/767 |
| 5,557,291 | A | 9/1996 | Chu et al. | |
| 5,661,494 | A | 8/1997 | Bondyopadhyay | |
| 5,845,391 | A | 12/1998 | Bellus et al. | |
| 6,191,750 | B1 | 2/2001 | Bonebright | |
| 6,351,246 | B1 | 2/2002 | McCorkle | |
| 6,396,453 | B2 * | 5/2002 | Amyotte et al. | 343/786 |
| 6,512,488 | B2 | 1/2003 | Schantz | |
| 6,525,696 | B2 | 2/2003 | Powell et al. | |
| 6,552,691 | B2 | 4/2003 | Mohuchy et al. | |
| 6,603,430 | B1 | 8/2003 | Hill et al. | |
| 6,703,981 | B2 | 3/2004 | Meitzler et al. | |
| 6,724,346 | B2 | 4/2004 | Le Bolzer et al. | |
| 6,765,539 | B1 | 7/2004 | Wang et al. | |
| 6,806,845 | B2 | 10/2004 | Fund et al. | |
| 6,859,176 | B2 | 2/2005 | Choi | |
| 6,911,947 | B1 | 6/2005 | Cranor et al. | |
| 6,977,624 | B1 | 12/2005 | Szente et al. | |
| 7,057,568 | B2 | 6/2006 | Louzir et al. | |
| 7,064,729 | B2 | 6/2006 | Olson | |
| 7,176,837 | B2 | 2/2007 | Sonoda | |
| 7,180,457 | B2 | 2/2007 | Trott et al. | |
| 7,209,089 | B2 | 4/2007 | Schantz | |
| 7,245,266 | B1 | 7/2007 | Szente et al. | |
| 7,280,082 | B2 | 10/2007 | Theobold et al. | |
| 7,327,315 | B2 | 2/2008 | Starkie et al. | |
| 7,403,169 | B2 | 7/2008 | Svensson et al. | |
| 7,443,350 | B2 | 10/2008 | Gaucher et al. | |
| 7,450,077 | B2 * | 11/2008 | Waterhouse et al. | 343/718 |
| 7,538,739 | B2 | 5/2009 | Tao | |
| 7,557,755 | B2 * | 7/2009 | Han et al. | 343/700 MS |
| 7,764,236 | B2 | 7/2010 | Hill et al. | |
| 7,768,470 | B2 | 8/2010 | Qin et al. | |
| 8,059,054 | B2 | 11/2011 | Mohammadian et al. | |
| 8,063,841 | B2 | 11/2011 | Peng et al. | |
| 8,138,985 | B2 | 3/2012 | Cooper | |
| 8,144,068 | B2 * | 3/2012 | Thevenard et al. | 343/767 |
| 8,149,172 | B2 | 4/2012 | Lu et al. | |
| 8,531,344 | B2 | 9/2013 | Ayatollahi et al. | |
| 8,564,491 | B2 * | 10/2013 | Peng | 343/786 |
| 2003/0011525 | A1 | 1/2003 | Sanad | |
| 2003/0218571 | A1 | 11/2003 | Yoon et al. | |
| 2004/0214543 | A1 | 10/2004 | Osone et al. | |
| 2004/0217911 | A1 | 11/2004 | Le Bolzer et al. | |
| 2005/0078042 | A1 | 4/2005 | Chua | |
| 2005/0099343 | A1 | 5/2005 | Asrani et al. | |
| 2005/0270243 | A1 | 12/2005 | Caimi et al. | |
| 2006/0181471 | A1 * | 8/2006 | Kim et al. | 343/767 |
| 2007/0018895 | A1 | 1/2007 | Bolin | |
| 2007/0046393 | A1 | 3/2007 | Quan et al. | |
| 2007/0096919 | A1 | 5/2007 | Knadle, Jr. et al. | |
| 2007/0258676 | A1 | 11/2007 | Windover | |
| 2008/0191946 | A1 | 8/2008 | Gustaf | |
| 2008/0292035 | A1 | 11/2008 | Chang | |
| 2009/0153410 | A1 * | 6/2009 | Chiang et al. | 343/702 |
| 2009/0251377 | A1 | 10/2009 | Peng et al. | |
| 2010/0053002 | A1 | 3/2010 | Wojack et al. | |
| 2010/0141551 | A1 | 6/2010 | Peng | |
| 2010/0315303 | A1 | 12/2010 | Kearney et al. | |
| 2011/0043301 | A1 | 2/2011 | Huettner | |
| 2011/0057852 | A1 | 3/2011 | Holland et al. | |
| 2011/0074649 | A1 | 3/2011 | Isom et al. | |
| 2011/0128199 | A1 | 6/2011 | He et al. | |
| 2011/0175787 | A1 | 7/2011 | Malak et al. | |
| 2011/0235755 | A1 | 9/2011 | Yang et al. | |
| 2012/0071214 | A1 | 3/2012 | Ash, Jr. et al. | |
| 2012/0146869 | A1 | 6/2012 | Holland et al. | |
| 2012/0169554 | A1 | 7/2012 | Behdad et al. | |
| 2012/0200468 | A1 | 8/2012 | Cooper et al. | |
| 2012/0200469 | A1 | 8/2012 | Cooper et al. | |
| 2012/0200470 | A1 | 8/2012 | Cooper et al. | |
| 2012/0206303 | A1 | 8/2012 | Desclos et al. | |
| 2012/0281162 | A1 | 11/2012 | Chen et al. | |
| 2012/0299786 | A1 | 11/2012 | Anguera et al. | |
| 2012/0313832 | A1 | 12/2012 | Pazin et al. | |
| 2012/0320506 | A1 | 12/2012 | Bentz et al. | |
| 2013/0035050 | A1 | 2/2013 | Gao et al. | |
| 2013/0169487 | A1 | 7/2013 | Liang et al. | |
| 2013/0187816 | A1 | 7/2013 | Chung et al. | |
| 2014/0055315 | A1 | 2/2014 | Cooper et al. | |
| 2014/0097997 | A1 | 4/2014 | Chang | |
| 2014/0118210 | A1 | 5/2014 | Cooper et al. | |
| 2014/0118211 | A1 | 5/2014 | Cooper et al. | |
| 2014/0333497 | A1 | 11/2014 | Cooper | |
| 2014/0354485 | A1 | 12/2014 | Cooper | |
| 2015/0222008 | A1 | 8/2015 | Cooper | |
| 2015/0333394 | A1 | 11/2015 | Nash et al. | |
| 2015/0340768 | A1 | 11/2015 | Rucker et al. | |
| 2015/0349401 | A1 | 12/2015 | Nash | |
| 2016/0190702 | A1 | 6/2016 | Rucker et al. | |
| 2016/0191693 | A1 | 6/2016 | Zavala | |

FOREIGN PATENT DOCUMENTS

| | | | |
|---|---|---|---|
| FR | 2785476 | | 5/2000 |
| JP | 59005705 | A | 1/1984 |
| KR | 100703221 | B1 | 4/2007 |
| KR | 1020070062187 | A | 6/2007 |
| KR | 1020130095451 | | 8/2013 |
| KR | 1020140089307 | | 7/2014 |
| RU | 2211509 | C2 | 8/2003 |
| RU | 2327263 | C2 | 6/2008 |
| RU | 2380799 | C1 | 1/2010 |
| RU | 2400876 | C1 | 9/2010 |
| WO | WO 98/20578 | A1 | 5/1998 |
| WO | WO 03/098732 | A1 | 11/2003 |
| WO | WO 2007/036607 | A1 | 4/2007 |
| WO | WO 2012/058753 | A1 | 5/2012 |
| WO | WO 2012/109392 | A1 | 8/2012 |
| WO | WO 2012/109393 | A1 | 8/2012 |
| WO | WO 2012/109498 | A1 | 8/2012 |
| WO | WO 2013/063335 | A1 | 5/2013 |
| WO | WO 2014/011943 | A1 | 1/2014 |
| WO | WO/2014/043401 | A1 | 3/2014 |
| WO | WO/2014/047211 | A1 | 3/2014 |
| WO | WO 2014/047567 | A1 | 3/2014 |
| WO | WO 2015/171963 | A1 | 11/2015 |
| WO | WO 2015/175550 | A1 | 11/2015 |
| WO | WO 2015/176064 | A1 | 11/2015 |
| WO | WO 2015/184469 | A2 | 12/2015 |
| WO | WO 2016/007958 | A2 | 1/2016 |
| WO | WO 2016/011076 | A1 | 1/2016 |
| WO | WO 2016/011181 | A1 | 1/2016 |

OTHER PUBLICATIONS

Sievenpiper D., et al., "Low-Profile, Four-Sector Diversity Antenna on High-Impedance Ground Plane", Electronics Letters, IEE Stevenage, GB, vol. 36, No. 16, Aug. 3, 2000, pp. 1343-1345.

* cited by examiner

CORRUGATED HORN ANTENNA WITH ENHANCED FREQUENCY RANGE

This application claims priority to U.S. Provisional Patent Application No. 61/440,983 filed on Feb. 9, 2011 and U.S. Provisional Application No. 61/441,004 filed on Feb. 9, 2011, both of which are to be considered included herein in their respective entirety by this reference.

BACKGROUND OF THE INVENTION

1. Field of the Invention

The present invention relates to broadband antennas and elements therefore for transmission and reception of radio frequency communications singularly or in arrays for providing multiple broadcast and reception streams. More particularly, it relates to planar horn antenna elements which are capable of broadband reception and transmission and which are employable individually or using individual elements integrated into arrays.

In use for a multiple-input and multiple-output scheme or MIMO, the novel-formed elements of the array may be closely spaced and receive and transmit signals in a broad spectrum between a high and low frequency point. A succession of recesses and projections positioned along the edges of both nodes of the element forming the horn provide a means to increase the operational frequency bandwidth of the formed element to exceed what the wide and narrow points of the element would normally dictate. Additionally, a mode of the device positioning of intermediate projections and recesses along the edge provides a means for enhanced impedance matching.

2. Prior Art

Since the inception of cellular telephones, smart phones, HDTV, digital radios, and other devices operating in various areas of the available spectrum, service providers have had the task of installing a plurality of antenna sites over a geographic area to provide communications to subscribers. Some such antenna sites are singular and cover a broad area, some are small or cellular and employ many smaller antenna sites with each covering a smaller area of the whole.

From inception to the current mode of digital broadcasting and reception, providers have each installed their own plurality of large external antennas for such cell sites. Individual antenna sites may employ one or a plurality of antennas operating on different frequencies. In practice, cell sites are grouped in areas of high population density with the most potential users. Because each cellular service provider has their own system, each such provider will normally have their own antenna sites spaced about a geographic area to form the cells in their respective system. In suburban areas, the large dipole or mast type antennas must be placed within each cell. Such masts are commonly spaced 1-2 miles apart in suburban areas and in dense urban areas may be as close as ¼-½ miles apart.

Such RF antennas, be they for digital communications, cell phones or HDTV, employ antenna sites with large towers and large masts are generally considered eyesores by the public. Because each provider has their own system of cell sites, and because each geographic area has a plurality of providers, antenna blight is a common problem in many urban and suburban areas.

The many different service providers employ many different technologies such as GSM and CDMA using industry standards for 3G and 4G (short for 3rd and 4th generation). They also employ these technologies on bandwidths the provider either owns or leases, and which are adapted to the technologies. Consequently, the different carriers tend to operate on different frequencies and since conventional dipole and other cell antennas are large by conventional construction, even where the different providers are positioning sites near each other, they still have their own cell towers adapted to the length and configuration of the large antennas they employ for their systems and which are adapted to their individual broadcast and receiving bands in the RF spectrum.

Since the many carriers and technologies employ different sized, large antennas, even if they wanted to share cell sites and antennas more often, the nature of the antennas used conventionally discourages it. The result being a plethora of antenna sites, some right next to each other, with large ungainly and unsightly antennas on large towers which are aesthetically unpleasing.

In the case of 3G and 4G technologies, data is broadcast in multiple independent RF streams in schemes such as MIMO to communicate data and voice to and from multiple antennas adapted to handle the frequency of each stream. Antennas conventionally must be spaced from each other at least ½ a wavelength of the RF frequency on which they operate to avoid problems with interference. In the case of a broadband antenna with a low end frequency of 700 Mhz, this can be at least a 17 inch spacing requirement of each of the plurality of antenna elements from each other. This physical requirement can be overcome using multiplexing of adjacent antennas to turn them off when one antenna is in broadcast mode or using complicated and expensive smart antenna schemes and switching techniques. However, performance lacks and is prone to problems using such techniques. Additionally, physical spacing, if employed, renders the antenna array for multi stream use very large if the lower frequencies are in the 600-800 Mhz spectrum.

Radio communication sites and television broadcasting sites, and WiFi sites, and other RF communications sites operate on other frequencies and employ customized antennas for such which are not adaptable easily to receive and transmit other areas of the radio spectrum.

As such, there is a continuing unmet need for an improved antenna element which is configured to operate in a broadband fashion between a high and low frequency and at all frequencies therebetween. Such an element should be adaptable in constructional dimensions to allow for transmission and receipt of RF communications throughout the available spectrums by a simple reconfiguration of dimensions. Further, such an antenna element should be capable of formation into arrays to increase their effectiveness.

Further, such an array should allow for close spacing of the antenna elements of the array and concurrent reception and broadcast by the multiple antennas closely spaced in the array, without complicated switching or multiplexing. Further, such a device should employ individual antenna elements which provide a very high potential for the as-needed configuration for frequency, frequency rejection, polarization, gain, direction, steering, impedance matching, and low spectrum enhancement, and other factors desired in a cellular system for the varying servicing requirements of varying numbers of users over a day's time.

Further, such a device should employ a wideband antenna radiator element able to service all of the frequencies employed by the multiple carriers from 470-860 Mhz, 680-2000 Mhz, 2-6 Ghz, 6-18 Ghz, 18-40 Ghz, and 40-100 Ghz, or in segments between 700 Mhz to 2100 Mhz. Ideally, such an antenna or element should allow for increased operational frequencies through the provision of novel edge shapes to a formed horn antenna to thereby maximize the ability of elements and arrays of such elements to send and receive RF signals from their mounted positions.

Finally, because impedance matching is so important to the ultimate performance of any antenna element, such an element should provide additional means to adjust component parts forming the element to change the required matching for the element and the task assigned it.

SUMMARY OF THE INVENTION

The disclosed antenna herein is especially adapted to handle the wide range of frequencies employed by multiple broadcasters, service providers, cellular carriers, and others providing RF communications in a geographic area. Further, through a unique notching and projection configuration, the disclosed device provides for a lower cut off frequency than would normally occur with the wide and narrow points on a horn antenna. In conjunction with the notches, a plurality of projections are also provided which may be adjusted in size along with the notches to provide a means to enhance impedance matching of the formed element.

The device may be employed as a single antenna in a single element or may form arrays of interconnected individual elements electrically connected to an array. Depending on the high and low cutoff frequencies of the elements formed, the individual arrays may be employed for HDTV, WiFi, Radio, MIMO and other multi-stream 3 G and 4 G communication's schemes with exceptional performance and, through changes in the formed widest and narrowest points of the formed horn, can be adapted to virtually any RF frequency range.

The unique configuration of the individual antenna radiator elements, with the flare angles of the edges of the two opposing planar nodes of the element forming a bump or node in a mid portion, and having notches along a steeper angled section, provides excellent transmission and reception performance in a wide band of frequencies such as between 680 Mhz-2200 Mhz and 2 Ghz to 100 Ghz depending on the distance between a widest and narrowest point of the formed element. To further enhance performance, the edges of the two nodes of the radiator element may employ opposing aligned recess cavities designed to lower the cutoff for low frequencies of the formed element beyond what would be the norm. In conjunction with the recess cavities are positioned projections which can be adjusted in size along with the cavities to provide a means for adjustment of impedance for impedance matching of the formed element.

The disclosed device, employing changing flare angles to edge sides forms a unique cavity from the widest point at an aperture which changes in its mirrored declining slope edges toward a center line at a first slope, and at a second slope toward the center line of the aperture where there are formed recess cavities and projections are situated which provide the noted bottom cut off increase as well as the impedance matching means. The flare angle change has been found to provide a significant improvement in mid range frequencies of the formed element and this increase in frequencies is further enhanced by the lowering of the low cutoff frequency provided by the recess cavities.

The elements disclosed may be employed singularly or may be formed to arrays. Formed to individual antennas in an array, each individual antenna is formed of a plurality of individual elements electrically communicating with each other and the transceiver. Each antenna in the array may be employed singularly or engaged with adjacent elements for gain and steering and is planar and formed on a single side of a dielectric substrate of such materials as MYLAR, fiberglass, REXLITE, polystyrene, polyimide, TEFLON, fiberglass or any other such material suitable for the purpose intended. The substrate may be flexible. However, in one particularly preferred mode of the device wherein a plurality of antenna elements are engaged to each other to increase gain or broadcast and receipt footprint, the substrate is substantially rigid in nature. The antenna element formed on the substrate can be any suitable conductive material, as for example, aluminum, copper, silver, gold, platinum or any other electrically conductive material suitable for the purpose intended. The conductive material is adhered to the substrate by any conventional known technology.

So formed, and using one or a plurality of the multi-element antennas, the disclosed device provided forms an array for MIMO type multiple-stream transmission and receiving of individual RF streams. All antenna elements, in the formed array, may concurrently broadcast and receive on all bands, with less than wavelength spacing, and with no need for complicated multiplexing and switching of adjacent antennas in the array.

In a preferred embodiment, the antenna elements are formed of the conductive material coating on a single first side of the dialectic substrate. The cavity is defined by opposing edges of the two halves or nodes of the antenna element at different slope angles which both slope toward a mid line of the element at a first slope, rises slightly for a distance toward the mid line, and then again traverses downward and toward the midline in a third portion.

Formed along the edges of both nodes, in the third portion of the slope, are opposing aligned recess cavities and projections. The cavities so positioned cause a slow wave structure along the edges of the horn and provide a means to lower the effective cutoff frequency which is normally determined by the distance at the narrowest gap between the two edges of the two nodes. The projections placed in-between the cavities provide a means to adjust impedance where the depth and size of the projections are for capacitance and the length and size of the projections are adjusted for inductance to achieve a proper impedance match condition.

From a distance, the formed element has the general appearance of having two substantially equal sized nodes with a throat portion therebetween defined by the edges of the nodes. This throat portion narrows in size from a widest point and extending in curvilinear fashion from the perimeter of one node section into the other forms the horn. Subsequent to reaching its narrowest point inline with a center point between the two nodes, the cavity extends to a distal end that is substantially circular and increasing in diameter.

A feed line is engaged to the element on the opposite side of the dialectic planar material adjacent to the throat at the bottom of the U-shaped curve of the throat. The feedline communicates energy at the communicated frequencies captured and transmitted by the antenna element at the substantially circular cavity to provide a smooth field transition for energy to and from the antenna element.

The area and circular shape of the formed circular cavity may be adjusted as another means to increase or decrease capacitance to match the feed line positioned on the opposite side of the substrate, and thereby allow for a secondary means of impedance matching to tune the element for maximum performance. Alternatively, a meanderline distal end to the feed line may also be provided and the length thereof adjusted as a further means for impedance matching so as to allow both the circular cavity and the meanderline to be adjusted in size to achieve maximum performance.

The unique dual node configuration and central aperture having flare angles forming the horn antenna, and the unique changing direction and slope forming the convergence of the throat, the selectively positioned recess cavities in the node edges, and projections therebetween, and the positioning of the feed line out of line with the substantially circular distal end of the throat, all combine to yield an antenna element of unique characteristics in that it will receive and transmit on multiple frequencies easily, and actually increase the lower cutoff of the element. The element may be used singularly in some instances and can be joined with other elements in an array to increase gain and shape the footprint yielded by the resultant antenna.

A central aperture or cavity beginning with a large uncoated or unplated surface area of the substrate between the side edges of the two halves forms a mouth of the antenna and is substantially centered between the two distal tip points on each node or half-section of the antenna element. The cavity extends at a minimal rate somewhat perpendicular to a horizontal line running between the two distal tip points and then curves into the body portion of one of the tail halves and extends away from the other half.

Along the cavity pathway, formed by node edges and the converging flare angles from the distal tip points of the element halves, the cavity narrows according to a slope of the flare angles formed by the edges of the two halves of the antenna element in its cross sectional area. This leads to the increased slope and narrowing of the formed cavity.

The narrowing cavity is at a widest point between the two distal end points of each node, and narrows to a narrowest point between each node. The cavity from this narrow point curves to extend to a distal end formed within the one node half, where it makes a short right angled extension from the centerline of the curving cavity.

The widest point of the cavity between the distal end points of the two nodes, determines the low point for the frequency range of the element. The narrowest point of the cavity between the two halves determines the highest frequency to which the element is adapted for use.

As noted, the novel recesses formed in the node edges in a mid portion of the cavity provide a means to increase the effective operational bandwidth of the element at the low end of the operational frequencies beyond what would be dictated by the gaps between the nodes. Using a slope change yielding a change in the linear flare angle of the edge of the two halves toward a midline of the element, the disclosed device has been found to yield exceptional results between the low and high end of frequencies. The changing flare angle in the mid portion of the converging edges has provided a significant improvement in gain in the middle portion of the frequency range and is especially preferred. Similarly, the employment of recess cavities along the steeper slope of the two edges of the nodes provides the noted means to increase the operational frequency bandwidth of the formed element by lowering the effective cutoff frequency. Placement of the projections between the cavities as noted provides a means to adjust impedance of the element for a matching.

On the opposite surface of the substrate from the formed radiator element, a feedline extends from the area of the cavity intermediate the first and second halves of the antenna element and passes through the substrate to a top position to electrically connect with the element which has the cavity extending therein to the distal end perpendicular extension.

The location of the feedline connection, the size and shape of the two halves of the radiator element, and the cross-sectional area of the cavity, may be of the antenna designers choice for best results for a given use and frequency. However, because the disclosed radiator element performs so well and across such a wide bandwidth, the current mode of the radiator element as depicted herein, with the connection point shown, is especially preferred. Of course, those skilled in the art will realize that the shape of the half-portions and size and shape of the cavity may be adjusted to increase gain in certain frequencies and reject certain frequencies or for other reasons known to the skilled. Any and all such changes or alterations of the depicted radiator element as would occur to those skilled in the art upon reading this disclosure are anticipated within the scope of this invention.

Further, the size of the formed circular cavity and its shape provide for a smooth field transition in combination with the feed line. Increasing or decreasing the area of the circular cavity provides a means for impedance matching. When combined with the meanderline feed line, which may also be changed in dimension and length, an additional increase in the range of impedance matching is provided wherein the capacitance of the formed circular cavity may be matched to the inductance of the meanderline feed line.

With respect to the above description, before explaining at least one preferred embodiment of the improved antenna element in detail, it is to be understood that the invention is not limited in its application to the details of operation nor the arrangement of the components or steps set forth in the following description or illustrations in the drawings. The various methods of implementation and operation of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other devices and systems for carrying out the several purposes of the wide-band antenna element herein. It is important, therefore, that the objects and claims be regarded as including such equivalent construction and methodology insofar as they do not depart from the spirit and scope of the present invention.

Further objectives of this invention will be brought out in the following part of the specification wherein detailed description is for the purpose of fully disclosing the invention without placing limitations thereon.

It is thus an object of this invention to provide an antenna element that is particularly adapted to transmit and receive in a wide range of RF frequencies.

It is a further object of this invention to provide such an element which is easily matched for impedance, and provides a unique structural component which increases the lower cut-off of the element.

These together with other objects and advantages which become subsequently apparent reside in the details of the construction and operation of the invention, as more fully hereinafter described and claimed herein, without being in any manner considered limiting in scope, with reference being had to the accompanying drawings forming a part thereof, wherein like numerals refer to like parts throughout.

BRIEF DESCRIPTION OF DRAWING FIGURES

FIG. 1 depicts a top plan view of the preferred mode of the antenna element herein shaped with two opposing nodes positioned on a substrate showing the distal points forming the widest point of the cavity "W" which narrows to a narrowest point "N" at a position substantially equidistant between the two distal points. Also shown is the slope change of the flare angles defined by the edges of the two halves defining a central aperture. The changing slope yields a secondary wide point W1 which has been shown to enhance the mid portion of the spectrum. As the cavity narrows selectively positioned recess cavities extend at distances R1, R2, and R3 therebetween to provide a means to increase the low cutoff of the element.

DETAILED DESCRIPTION OF THE PREFERRED EMBODIMENTS OF THE INVENTION

Figure 1:
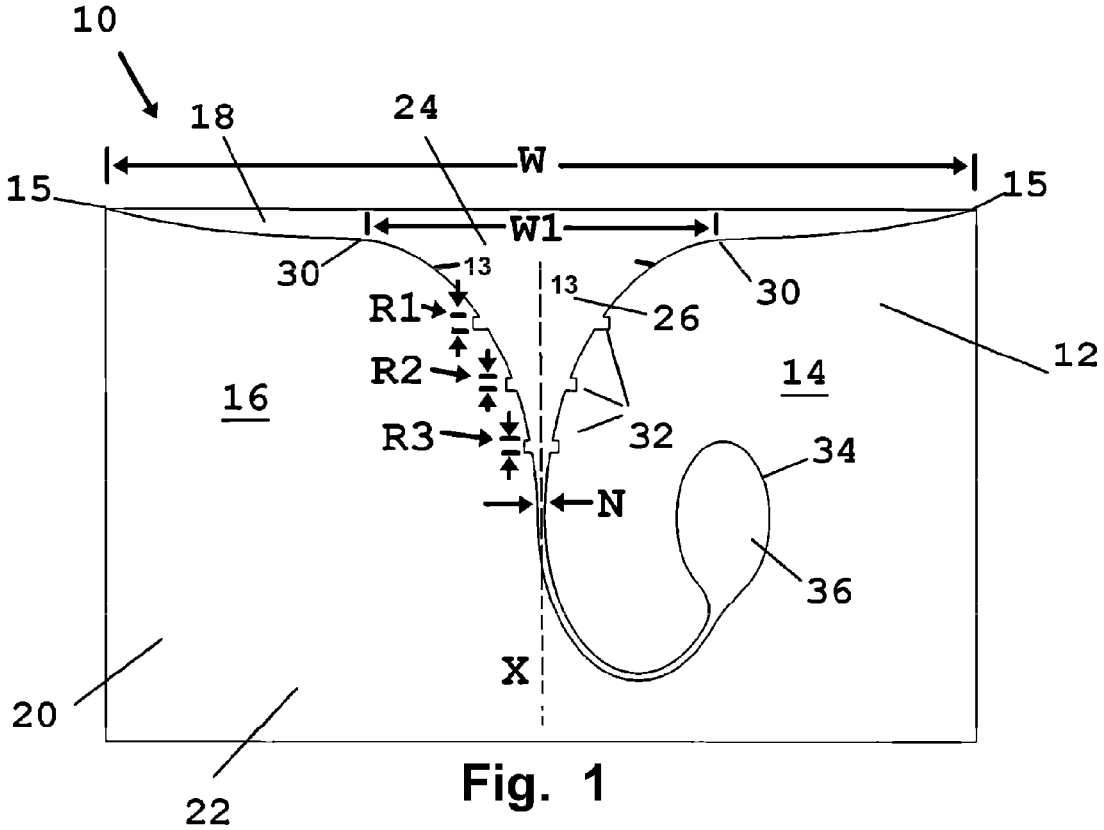

Referring now to the drawings of FIGS. 1-6, in FIG. 1 depicting the antenna element 12 of the device 10, the element 12 having two half portions or nodes which are formed by a first node 14 and second node 16 being substantially identical or mirror images of each other. Each antenna element 12 of the invention is formed on a dialectic substrate 18 which as noted is non conductive and may be constructed of either a rigid or flexible material such as, MYLAR, fiberglass, REXLITE, polystyrene, polyamide, TEFLON fiberglass, or any other such material which would be suitable for the purpose intended.

A first surface 20 is coated with a conductive material by microstripline or the like or other metal and substrate construction well known in this art. Any means for affixing the conductive material to the substrate is acceptable to practice this invention. The conductive material 22 as for example, include but are not limited to aluminum, copper, silver, gold, platinum or any other electrical conductive material which is suitable for the purpose intended.

As shown in FIG. 1, the surface conductive material 22 on first surface 20 is etched away, removed by suitable means, or left uncoated in the coating process to form the first and second nodes 14 and 16 of the antenna element, and having a mouth 24 leading to a curvilineal cavity 26.

The cavity 26 extending from the mouth 24 has a widest point "W" and extends between the curved side edges 13 of the two nodes 14 and 16 to a narrowest point "N" which is substantially equidistant between the two distal tips 15 and which is positioned along an imaginary line X substantially perpendicular the line depicting the widest point "W" running between the two distal tips 15 on the two nodes 14 and 16.

The widest distance "W" of the mouth 24 portion of the cavity 26 running between the distal end points 15 of the radiator halves 14 and 16, determines the low point for the frequency range of the device 10. The narrowest distance "N" of the mouth 24 portion of the cavity 26 between the two halves 14 and 16 determines the highest frequency to which the device 10 is adapted for use.

Particularly preferred, in the device 10, is a mid portion of the cavity 26 along side edges of both halves 14 and 16 which have a flare angle slope change 30 toward the mid line X of the device. This mid portion starting at the ends of the line W1, occurs when the flare angles on the edges of the two halves 14 and 16 changes to a decreasing declining angle for a distance, whereafter the angle of decline toward the midline X increases again where recess cavities 32 are positioned at intervals R1, R2, and R3 and provide a means to lower the cutoff frequency of the formed element past what it would be based on the noted spacing at the widest and narrowest points. The recess cavities 32 are formed by a continuous recess edge extending into a respective lobe edge 13 at two corners 35. The recesses extend along an imaginary axis substantially perpendicular to the shown center line "X" and have side edges which would be equal in length but one of them being reduced by the slope of the two lobe edges 13 which define a declining width of the cavity 26 from the mouth defined at line "W". By removing opposing individual sections in matched positions along each respective lobe edge 13, a plurality of matched recess cavities 23 are positioned spaced along the lobe edge 13 which continues at its defined slope between respective corners 35 of each recess cavity 33.

Figure 2:
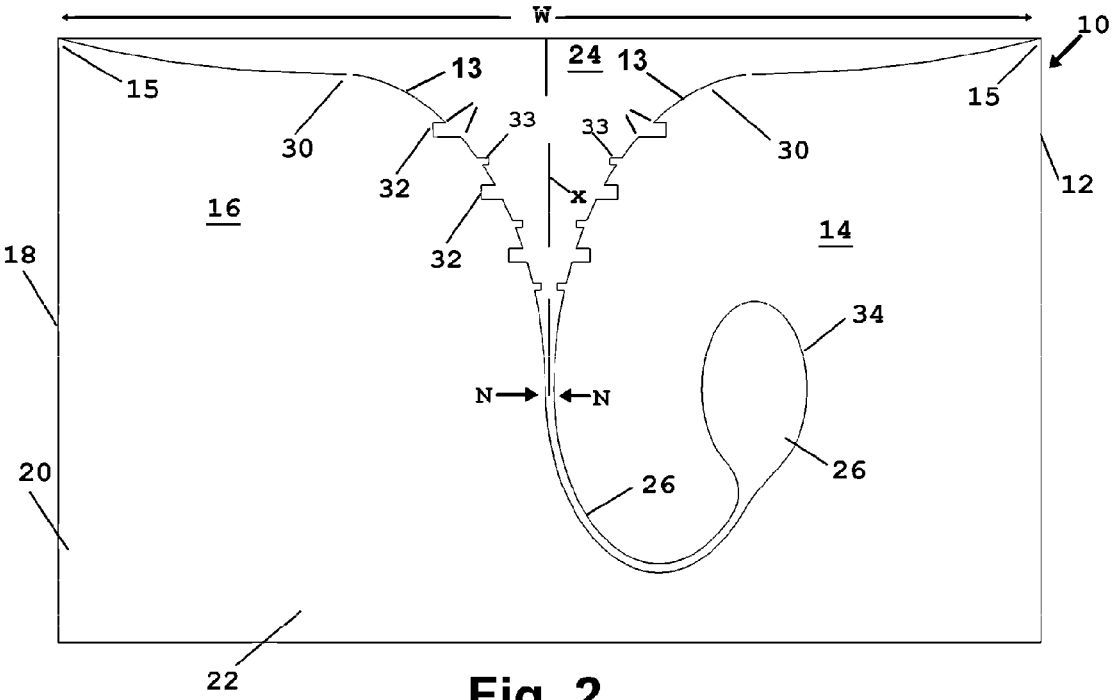
FIG. 2 is similar in all aspects to FIG. 1 with the addition of projections extending from the edges of the cavity.
Figure 3:
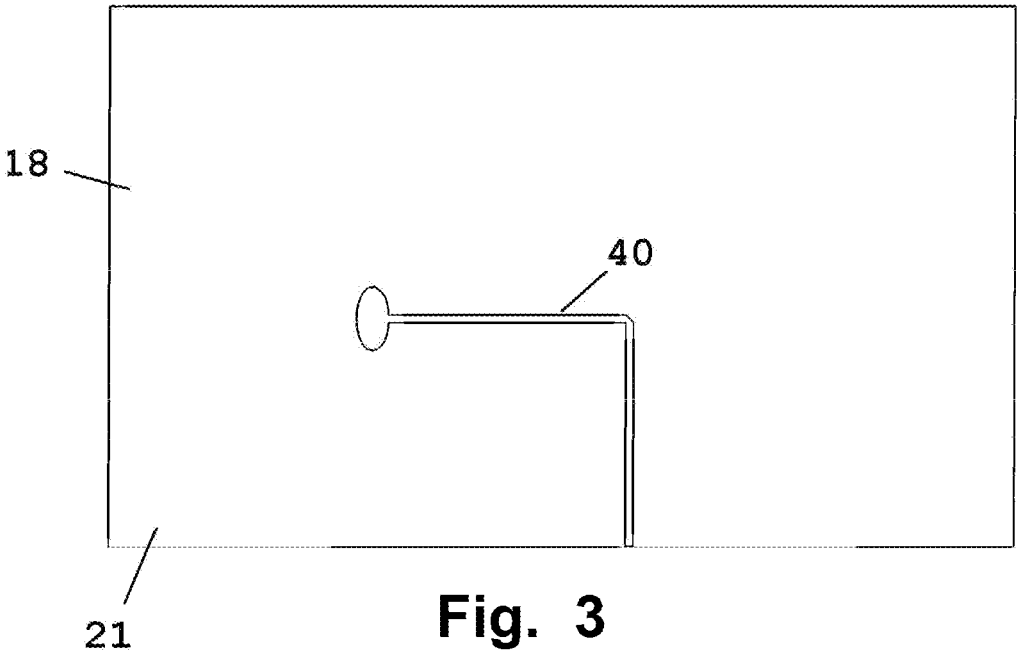
FIG. 3 depicts a rear side of the planar substrate on which the radiator element is mounted, showing the feedline engaging the element to capture or transmit energy therefrom.

In FIG. 2, the device of FIG. 1 is shown with the addition, positioned between the cavities 32, of projections 33. These projections have been found to provide a means to match impedance and to that end may be adjusted in size relative to the cavities 32 or along with the cavities 32 to provide a means for impedance matching of the device 10. In such an adjustment, the projections 33 and cavities 32 for both size and positioning relative to each other provides a means to form an L and C impedance matching circuit on the element to maximize the impedance match of the formed element for its spectrum. The protrusions 33 should each have a constant width and length and thereby provide a smooth field transition for energy from the horn.

The device as shown in FIG. 1 or 2, employs a mid portion with the change in the flare angle defined by the edges of the halves 14 and 16, which has been found to particularly increase performance in the mid range of the antenna element between its highest and lowest frequency as determined by spacing as noted. The mid portion adjustment slope change 30 has also provided a means to fine tune the device and enhance impedance matching to allow for common matching circuitry of the device with other antennas of different sizes between W and N. The element will work well in other frequency ranges where W equals substantially ½ the wave length of the lowest frequency and N equals ½ the wavelength of the highest.

For instance, where the widest distance "W" is at a distance adapted to receive the lowest cellular frequencies in the 680 Mhz, and narrowest distance "N" is at a distance adapted to receive the highest frequencies up toward and above the 1900 Mhz high end, the element will work well in that range.

The cavity 26 proximate to the narrowest distance "N" curves into the body portion of the first node 14 and extends away from the other the second node 16. The cavity 26 extends to a distal end 34 within the first node 14 where it increases in diameter to a substantially circular portion 36.

This substantially circular portion 36, when adjusted in area or shape, provides a means for impedance matching by adjusting the capacitance of the element to the feed line inductance.

On the opposite surface of the substrate 18 shown in FIG. 2, a feedline 40 extends from the area of the cavity 26 intermediate the two nodes 14 and 16 forming the two halves of the radiator element 12 and passes through the substrate 18 to electrically connect to the first node 14 and second node 16 adjacent to the edge of the curved portion of the cavity 26 past the narrowest distance "N". As noted, the change in the flare angles at the mid position 30 in the cavity 26 also enhances impedance matching of the device with others.

The location of the feedline 40 connection, the size and shape of the two halves 14 and 16 of the antenna element 12, and the cross-sectional area of the widest distance "W" and narrowest distance "N" of the cavity 26, and the change in slope angle along line W1, are adapted in size and distance to receive captured energy at a wide range of frequencies and in this configuration performs well and across the entire RF bandwidth and is especially preferred.

The radiator element 12 may be adapted in dimension to optimize it for other RF frequencies between a maximum low frequency and maximum high frequency and those that fall therebetween. This may be done by forming said halves 14 and 16 to position the distal tips 15 at a widest point "W", which is substantially one half the distance of the length of an RF wave radiating at the maximum low frequency desired or alternatively but less preferred at one quarter the distance of the wave. To determine the maximum high frequency for the element 12, it would be formed with a narrowest point "N" of the mouth having a distance which is substantially one half or one quarter the distance of the length of the RF wave radiating at the highest frequency desired. This may be done by adjusting the curved edges defining the flare angels on edges of halves 14 and 16 slightly to accommodate the narrower or wider narrowest point "N".

In all modes of the device adapted for desired frequencies as described herein, the slope change 30 of the flare angles on the edges of the halves 14 and 16, toward the center line X, to form the mid portion is also preferred to enhance the mid spectrum gain and provide an aid in impedance matching of the device.

Figure 4:
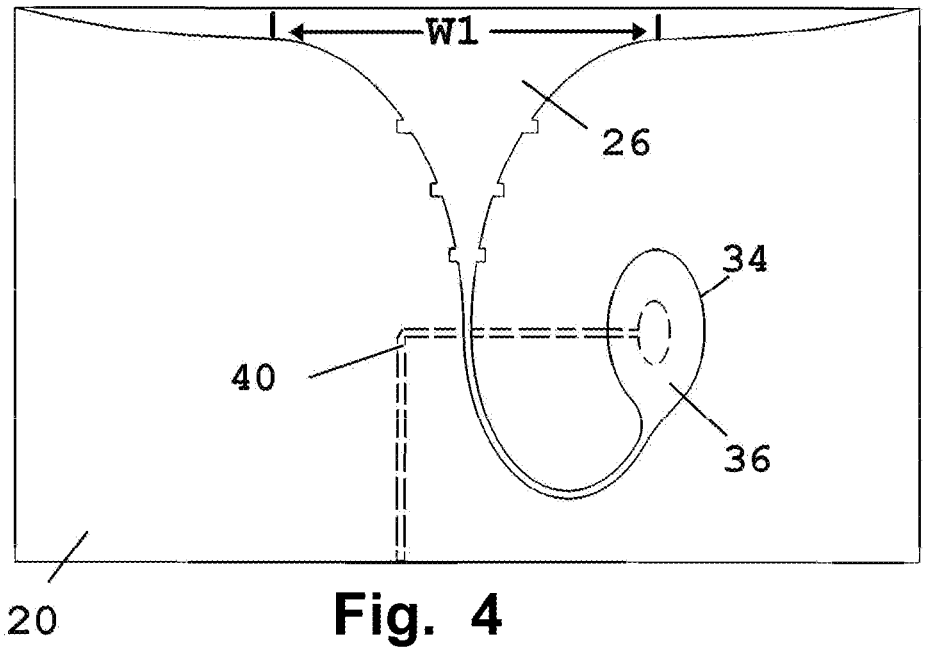
FIG. 4 depicts again a top plan view of the preferred mode of the device showing the relative placement of the feedline (depicted by the dashed line) to the radiator element.

To better understand the location and orientation of the feedline 40 positioned on the opposite or second surface 21 relative to the cavity 26, another top plan view of the first surface 20 is seen in FIG. 4 with the feedline 40 engaged on the second surface 21 depicted by a dashed line.

Figure 5:
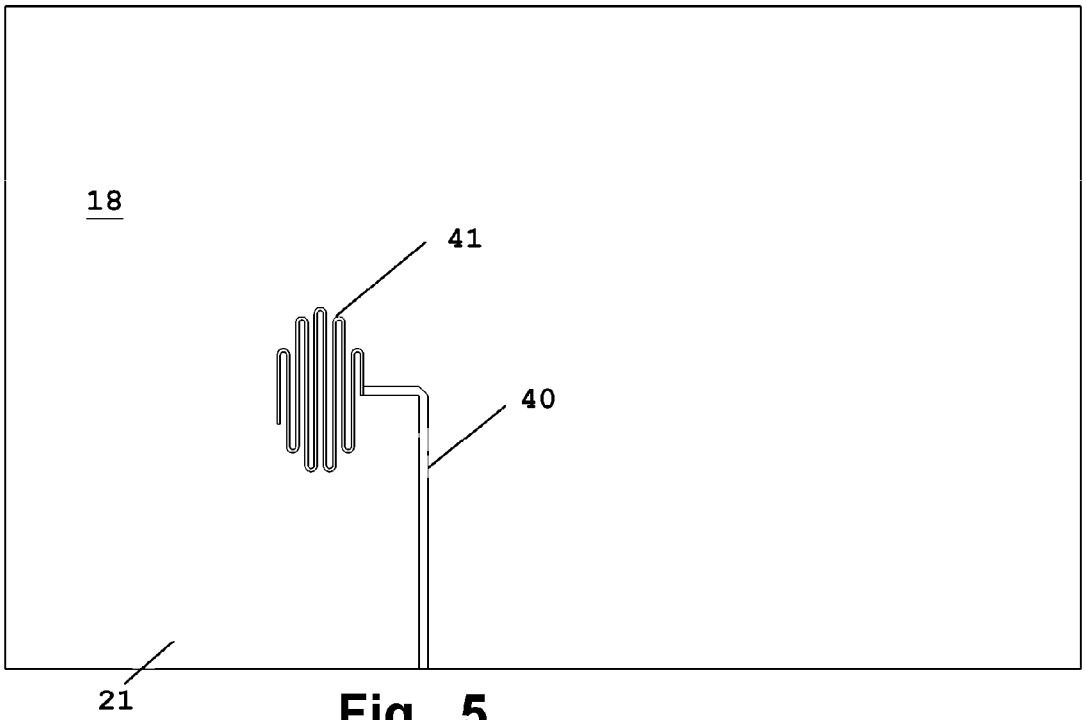
FIG. 5 shows a feedline element having a meanderline shape at formed of legs at its distal end which is adjustable in size to change a formed bulbus portion, to provide for impedance matching.

In FIG. 5 is shown a feedline 40 having a distal end with bulbus portion formed by a meanderline 41 shape of individual legs of the feedline. The size and length of the meanderline legs may be adjusted in size to change the size of the bulbous portion to provide for impedance matching with the circular end of the cavity formed by the circular potion 36, which may also be adjusted in area to aid in such matching. Further, the meanderline 41 portion will function as an antenna radiator on its own, at frequencies adapted for reception on the length of the legs of the meanderline 41 or the total length thereof. This provides the device a second element with the first for reception and/or transmission.

Figure 6:
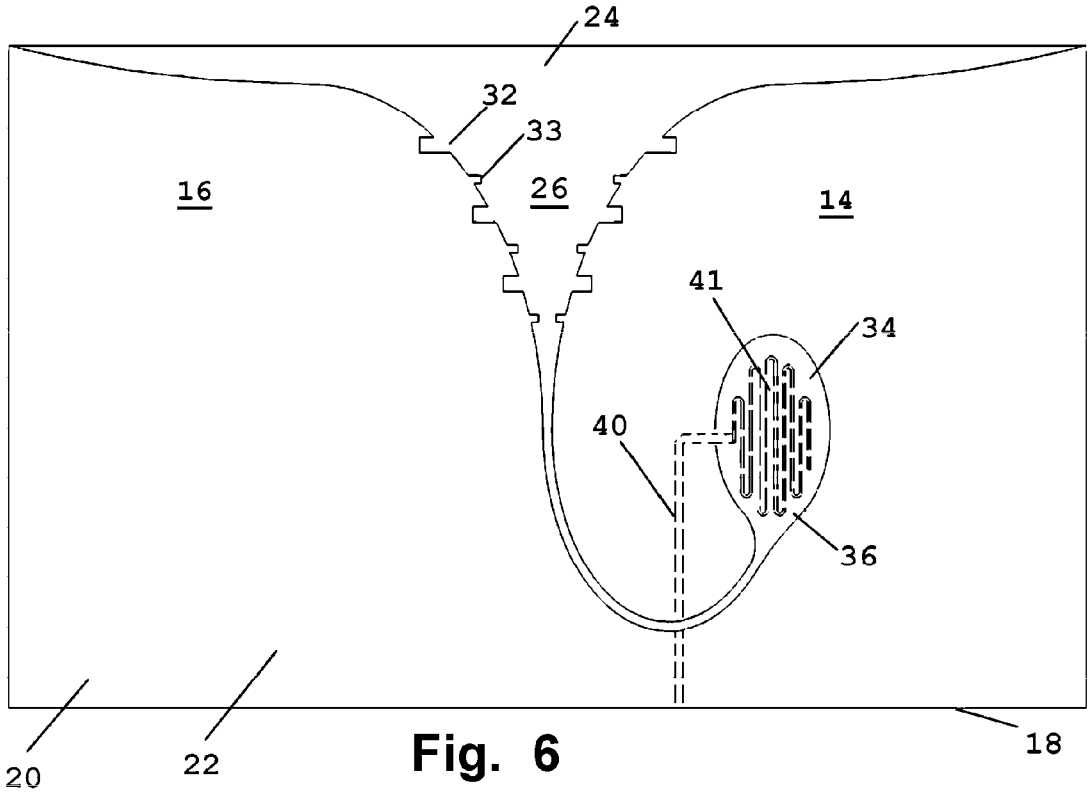
FIG. 6 depicts the radiator element of FIG. 2 having the feedline of FIG. 5 shown in broken line to depict the relative positioning thereof on the opposite side of the formed element.

In FIG. 6 is shown, in broken line to signify positioning on the other side, the feedline 40 having a meanderline 41 shape at its distal end which is adjustable in size to provide for impedance matching with, and in a relative position with, the circular end of the cavity which may also be adjusted in area to aid in such matching.

While all of the fundamental characteristics and features of the invention have been shown and described herein, with reference to particular embodiments thereof, a latitude of modification, various changes and substitutions are intended in the foregoing disclosure and it will be apparent that, in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A radiator element for RF communications, comprising:

a planar dielectric substrate;

a first substrate surface of said substrate having a portion of which is covered with a conductive material and a portion of which is uncovered, said first substrate surface having respective opposing side edges, an upper edge, a bottom edge and a centerline, said centerline substantially centered between and parallel to said respective opposing side edges;

said conductive material forming a pair of lobes having substantially identical shapes;

said lobes having respective said opposing side edges defining opposing sides of a cavity positioned upon said uncovered substrate surface;

said lobes extending in opposite directions to respective distal tips;

said cavity having a mouth portion, said mouth portion beginning at said upper edge, along a line extending between said distal tips;

said cavity reducing in cross-section from said upper edge as it extends to a narrowest point substantially centered between said respective side edges of said lobes;

said cavity further defined by a pair of curved edges, each of said pair of curved edges extending between one of said distal tips and said narrowest point of said cavity, each of said pair of curved edges forming a boundary between a portion of said cavity and a portion of each of said pair of lobes;

recess cavities formed in said conductive material at respective opposing positions on opposing sides of said centerline and extending from each said curved edge outward toward one of said respective side edges of said lobes, said recess cavities providing a means for enhanced reception of frequencies specific to distances between respective pairs of said recess cavities formed in said respective opposing positions;

a curved portion of said cavity extending downward toward said bottom edge from said narrowest point in a curved direction into a first one of said lobes, wherein said curved portion forms a substantially oval configuration; and a feedline positioned on a second surface of said substrate, wherein said second substrate surface is opposite said first substrate surface, wherein said feedline comprises a substantially oval portion that is aligned within said substantially oval configuration, and wherein said feedline is configured to electrically communicate at a first position with one of said lobes, said feedline adapted at a second end for electrical communication with an RF receiver or transceiver.

* * * * *